United States Patent [19]

Rabitsch

[11] Patent Number: 4,578,904

[45] Date of Patent: Apr. 1, 1986

[54] WINDOW WITH TAKE-OUT FIXED SASH

[76] Inventor: Benjamin F. Rabitsch, P.O. Box 1062, Millen, Ga. 30442

[21] Appl. No.: 574,601

[22] Filed: Jan. 26, 1984

[51] Int. Cl.[4] ..... E05C 21/02

[52] U.S. Cl. ..... 49/465; 292/219; 292/228; 49/261

[58] Field of Search ..... 49/465, 261; 292/219, 292/228

[56] References Cited

U.S. PATENT DOCUMENTS

| | | | |
|---|---|---|---|
| 2,014,587 | 9/1935 | Roedding | 292/219 X |
| 4,257,193 | 3/1981 | Williams | 49/465 |
| 4,424,646 | 1/1984 | Adams | 49/465 X |

FOREIGN PATENT DOCUMENTS

| | | | |
|---|---|---|---|
| 2030158 | 12/1971 | Fed. Rep. of Germany | 49/261 |

*Primary Examiner*—Kenneth Downey
*Attorney, Agent, or Firm*—Harvey B. Jacobson

[57] ABSTRACT

A window having a fixed sash which can be easily removed and replaced for cleaning the transparent windowpane or for replacement of the windowpane in the event of breakage. The fixed sash of the window is usually associated with the upper portion of a window frame with a movable bottom vent being mounted in the window frame for vertical movement between a lowered closed position and a raised open position with a latch mechanism securing the movable vent in closed position. The window frame which receives the fixed upper sash and the movable lower or bottom vent is secured to an opening in a building wall in the conventional manner of prime windows and may be in the form of vertical and horizontal frame components constructed of extruded aluminum structural members with a centrally located meeting rail also constructed of an extruded aluminum rail rigidly fixed together in a manner to form a window frame with the fixed sash and movable vent being mounted in the frame in a manner that the movable vent can be moved to an upper position and removed from the frame with the fixed sash including unique retaining devices along the side and top rails to securely retain the frame of the fixed sash in the window frame but yet enable simple and easy removal thereof without requiring the use of special tools and without requiring any modification of the window frame.

11 Claims, 6 Drawing Figures

WINDOW WITH TAKE-OUT FIXED SASH

BACKGROUND OF THE INVENTION

1. Field of the Invention

The present invention generally relates to a window construction for use in various buildings and especially residential housing including individual homes, town homes, apartments, condominiums and the like in which the window is provided with a fixed sash in the upper end portion thereof which can be easily taken out and replaced for cleaning, repair and the like. The take-out fixed sash is retained in a conventional window frame by pivotal retainer or latch structures that are substantially concealed but yet easily operable without requiring any special tools and without requiring modification of the window frame with the weatherproof integrity of the fixed sash being maintained.

2. Description of the Prior Art

Windows of various types including prime windows, storm windows and the like have been constructed with various arrangements of movable vents and fixed sashes with some windows including two movable vents and screen assemblies any of which may be stored, removed and secured in closed position. Most prime windows include a structure in which the bottom vent at least is vertically movable in order to provide air circulation. Frequently, the upper sash of the window is fixed with the window frame including a meeting rail supporting the lower edge of the upper fixed sash and providing a structure by which the upper edge of the movable vent can be latched to retain the bottom movable vent in closed position. Also, the window frame as well as the fixed sash frame and movable vent frame are frequently constructed of extruded aluminum components with the window frame including structure to enable the movable vent to be removed from the frame when in a fully elevated position which enables easy cleaning and replacement of the transparent pane in the bottom vent in the event of breakage. However, windows of this type in which the upper sash is fixed present a problem to a person faced with the task of cleaning the exterior of the transparent pane in the fixed sash or the task of replacing a broken transparent pane since the fixed sash is in an elevated position in relation to the floor surface of the residence. A person can lean out of the lower end of the window or set on the windowsill with their upper torso exteriorly of the window when cleaning the exterior surface thereof which presents a danger of falling, especially if the person cleaning the window is elderly, handicapped or the like. Thus, existing window constructions present a problem when it becomes necessary to clean or replace the upper fixed sash.

SUMMARY OF THE INVENTION

An object of the present invention is to provide a take-out fixed sash for a window of the type including a movable bottom vent in which the fixed sash includes a frame associated with the window frame to maintain weatherproof integrity with the fixed sash being associated with the window frame and retained in place by secure but yet easily operated retaining devices to facilitate easy removal and replacement of the fixed sash for easy cleaning of the transparent pane or replacement thereof in the event of breakage.

Another object of the invention is to provide a window with a take-out sash which can be easily removed and replaced in which the sash includes a frame peripherally sealed to the window frame to maintain weatherproof integrity and including substantially concealed retaining devices along the side and top edges of the sash engaged with the window frame with the retaining means being easily manipulable without special tools and without requiring any modification of the window frame.

A further object of the invention is to provide a window with a take-out fixed sash as set forth in the preceding objects in which the retaining means is in the form of a plurality of pivotally mounted, elongated retainer plates that have an inner edge pivotally engaged in a recess in the fixed sash frame and an outer edge which is spring-biased outwardly and engages an inwardly extending flange on the window frame and is retractable from engagement therewith by exerting inward pressure on the outer end of the retaining plate.

Still another object of the invention is to provide a window in accordance with the preceding objects in which the retaining plate includes an arcuately curved flange on its swinging edge for guiding engagement with a portion of the fixed sash and includes downwardly struck tongues engaged in a coil spring which resiliently biases the retaining plate in latched position with the window frame.

A still further object of the invention is to provide a window in accordance with the preceding objects which is simple in construction, relatively inexpensive to manufacture, adaptable to various types of window structures and enables easy and quick removal and replacement of a fixed sash for cleaning and replacement.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
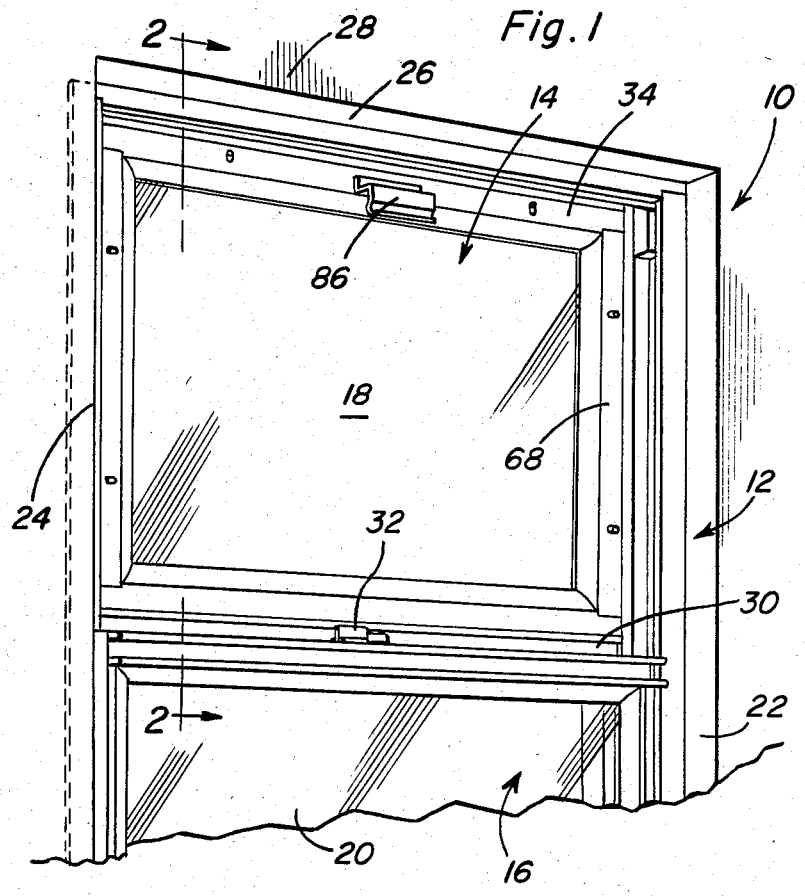
FIG. 1 is a partial perspective view of a window incorporating the take-out fixed sash of the present invention therein.

The window of the present invention is generally designated by the numeral 10 and includes a generally rectangular window frame 12, an upper fixed sash 14 and a lower movable vent 16 with the fixed sash 14 including a transparent pane or light 18 and the movable vent 16 also being provided with a similar transparent pane 20.

The window frame 12 is of conventional construction and includes vertically disposed side rails 22 and 24 and top and bottom rails 26 all of which are of extruded aluminum material and associated with an opening in a building wall 28 in a conventional manner. The side rails 22 and 24 are interconnected by a meeting rail 30 which forms a support and seal for the lower edge of the fixed sash 14 and a keeper structure for the latch 32 for the movable vent 16 to retain it in closed position. The aforementioned structure is substantially conventional window structure which includes an upper fixed sash and a bottom movable vent.

Figure 2:
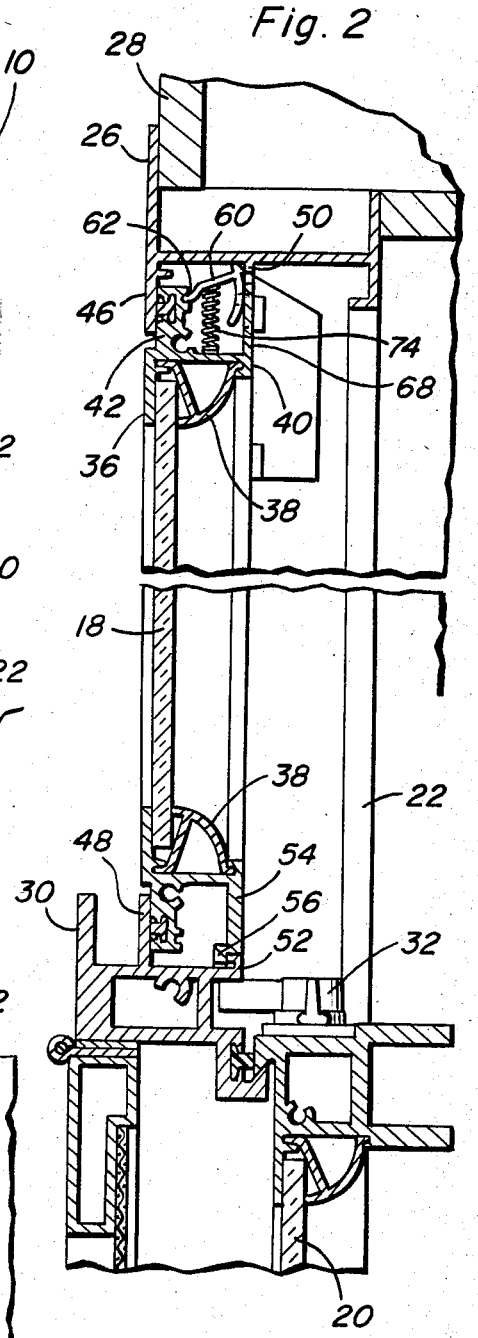
FIG. 2 is a sectional view, on an enlarged scale, taken substantially upon a plane passing along section line 2—2 illustrating various structural details of the window and take-out sash.
Figure 3:
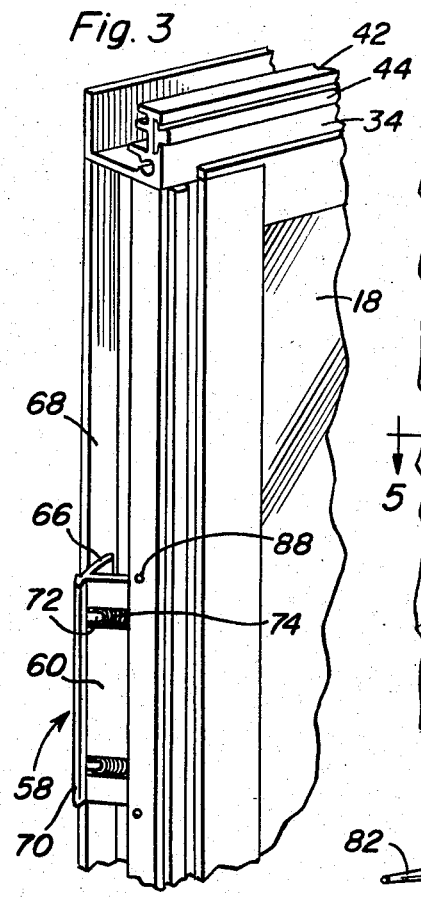
FIG. 3 is a fragmental perspective view of one corner of the take-out sash.
Figure 4:
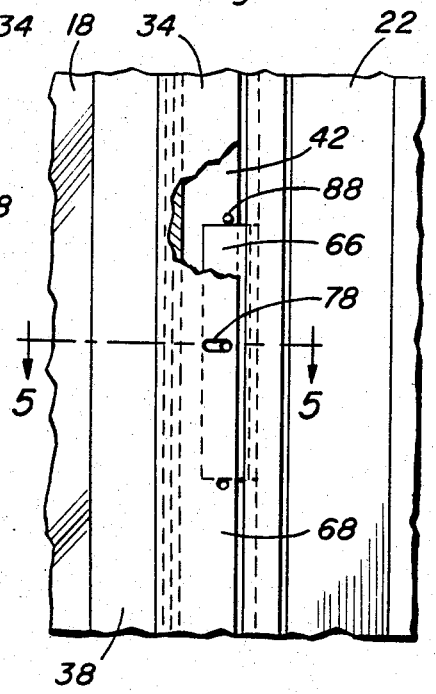
FIG. 4 is a fragmental view with portions broken away illustrating the window frame and fixed sash and retainer associated therewith.
Figure 5:
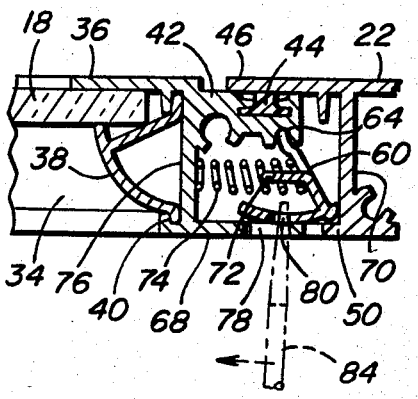
FIG. 5 is a sectional view taken along section line 5—5 on FIG. 4 illustrating the structural details of the fixed sash and retainer and its association with the window frame.
Figure 6:
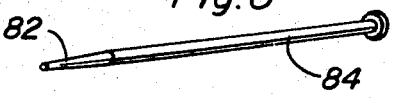
FIG. 6 is a perspective view of a simple pointed tool used in manipulating the retainer.

The fixed sash includes a peripheral frame 34 formed of extruded aluminum rails forming a rectangular frame receiving the transparent pane against an inwardly extending flange 36 and retained in sealed relation thereto by a sealing strip 38 having one edge engaging the transparent pane 18 and the other edge engaged with an inturned flange 40 in opposed relation to the flange 36 as illustrated in FIGS. 2 and 5 and which represents conventional sealing structure for the transparent panel 18 which is also provided with a bedding material, such as putty or sealant, between the flange 36 and the transparent pane 18 which also is conventional. The frame 34 also includes an outwardly extending flange 42 having a sealing strip 44 received in a groove facing the inwardly extending flange 46 on the window frame 12 in order to provide weathertight integrity between the window frame 12 and the sash frame 34. The window frame 12 includes the inwardly extending peripheral flange 46 and also includes a similar flange 48 on the meeting rail 30 which is engaged by the sealing strip 44. In opposed relation to the flange 46 on the top and two sides of the window frame is a short inwardly extending flange 50 and on the meeting rail 30 in opposed relation to flange 48, there is a short inwardly extending flange 52 with the peripheral frame 34 of the fixed sash closely passing through the opening defined by the inner edges of the flanges 50 and 52.

The frame 34 includes a lower rail 54 having an offset lower edge 56 which fits in behind the flange 52 to lock the lower edge of the lower rail 54 of the fixed sash 14 in place with the sealing strip 44 engaging the flange 48. The two side rails and the top rail 42 which define the remainder of the sash frame 34 are each provided with a pair of fastener assemblies 58 with each fastener assembly 58 including a plate 60 having a slightly downwardly offset and curved inner edge 62 that is pivotally engaged in a groove 64 in the inner surface of the frame rail 42. The free edge of the plate 60 remote from the groove 64 is provided with an arcuate plate 66 integral therewith which extends interiorly of an inner flange 68 on the frame rail 42 which enables the plate 66 to arcuately swing so that the apex of the juncture between plate 60 and arcuate plate 66 as designated by numeral 70 will engage behind or inwardly of the short flange 50 when the frame 34 is positioned so that it is completely within the window frame with the seal 44 in partially compressed engaged relation to the flange 46. The plate 60 is provided with a pair of longitudinally spaced downwardly or inwardly struck tongues 72 which telescopically receive one end of a coil spring 74 which has its lower end engaged with an inner wall or flange 76 forming part of the frame rail 42 to spring-bias the plate 66 outwardly but yet enabling the plate 60 to be moved inwardly by compressing the spring 74 when the inner edge of the flange 50 cammingly engages the outer surface of the plate 60 during inward movement of the fixed sash frame 34 into the window frame 12. Also, the flange 68 on the frame rail 42 is provided with an opening 78 in alignment with an opening 80 in the arcuate plate 66 in order to insert the tip end 82 of a pointed tool 84 so that the plate 60 can be moved inwardly to release the apex 70 from behind the flange 50 in order to release the frame sash 34 for removal. A handle 86 is provided on the center of the top rail of the sash frame 34 to facilitate handling and manipulation thereof.

Any suitable type of tool may be employed such as a small nail, small screwdriver or the like for insertion into the hole 80 so that inward force can be exerted to move the latching edge 70 at the juncture between the plate 60 and the arcuate plate 66 inwardly so that the sash frame can be released from the window frame 12. By releasing the top and two sides of the sash frame 34, the upper edge thereof may be pulled inwardly sufficiently to lift the offset lower edge 56 of the rail 54 above the top edge of the flange 52 so that the fixed sash 14 may then be removed for cleaning or replacement of the transparent pane 18. When it is desired to replace the fixed sash 14, it is only necessary to insert the lower edge thereof inwardly of the flange 52 and then force the sash frame 34 inwardly with the inner edges of the flanges 50 camming the plates 60 inwardly until the latching edge 70 passes inwardly of the flanges 50 at which time the latching edge 70 will move outwardly thus securely locking the fixed sash 14 in the window frame 12. The channel-shaped configuration of the frame rail 42 enables the longitudinal insertion of the fastening assembly 58 with the portions of the rail 42 adjacent each end of the plate 60 being deformed inwardly or staked as at 88 in order to retain the fastening assembly 58 in place. No other modification of the rail 42 is necessary. The elongated area of engagement of the latching edge or flange 70 with the flange 50 along the top and two sides of the window frame provides adequate support for the fixed sash 14 and enables the fixed sash and window frame to pass required load tests for installation and various housing arrangements. The window frame may vary in construction insofar as the external periphery thereof is concerned to fit into and be mounted in various window openings in a wall with the sash 14 of the present invention being capable of being used in various types of window assemblies. The structure of this invention also enables easy removal and replacement to facilitate cleaning and repair when necessary.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A window frame having a fixed upper sash and a movable bottom vent, said fixed upper sash comprising transparent panel means having a peripheral frame closely received in said window frame and means interconnecting the peripheral frame of the fixed sash and the window frame to enable the fixed sash to be taken out and removed from the window frame to enable cleaning of the transparent panel means or replacement when necessary, said means securing the peripheral frame of the fixed sash to the window frame including an inwardly extending flange on the window frame and retractable means on the peripheral frame of the fixed sash engaging the inner surface of the flange along a substantial portion of the length thereof, said retractable means including a plurality of pivotal latch members mounted on the peripheral frame with each member including an elongated surface engaging a portion of the longitudinal inner surface of the flange on the window frame, each of said pivotal latch members being in the form of an arcuate plate swingable in an arcuate path for retraction completely within the confines of the peripheral frame, said peripheral frame on the fixed sash being generally channel-shaped with the flange exposed to the interior of the window including means enabling access to the arcuate plate for retracting the arcuate plate from engagement with the flange on the window frame, said arcuate plate including a laterally extending mounting plate having spring means associated therewith to bias the arcuate plate outwardly of the peripheral frame, the flange of the peripheral frame remote from that providing access to the acruate plate including a longitudinal groove pivotally receiving the edge of the mounting plate, the flange providing access to the arcuate plate including inwardly offset portions securing the retractable means from longitudinal movement in the channel of the peripheral frame after insertion to facilitate ease of assembly.

2. The structure defined in claim 1 wherein said flange providing access to the arcuate plate and the arcuate plate include apertures for receiving a pointed implement with the aperture in the flange of the peripheral frame being elongated to enable retractable movement of the arcuate plate and the mounting plate to retracted position.

3. A take-out window sash for use with a window frame having a pair of laterally spaced inwardly extending flanges with the outer flange having an inner edge disposed inwardly of the inner edge of the inner flange, said window sash having an outer edge insertable through the inner flange and into engagement with the interior surface of the outer flange, said window sash including a peripheral frame and means carried by said peripheral frame engaging the interior surface of said inner flange for securing the window sash in the window frame, said means being movable between an extended position engaged with the inner flange on the window frame and a retracted position disengaged from the inner flange on the window frame, said means including a retainer plate having an elongated edge engaging the interior surface of the inner flange on the window frame along the entire length of the retainer plate, said peripheral frame including radially extending recess means receiving said retainer plate, said retainer plate including one longitudinal edge pivotally engaged with the outer wall of the recess means with the other longitudinal edge being arcuately swingable into extended and retracted positions, the edge of said plate engageable with the inner flange on the window frame including an arcuate plate movable into and out of the recess means, said recess means including an inner wall having an aperture therein through which a tool may be inserted to engage and retract the arcuate plate.

4. The window sash as defined in claim 3 together with spring means in said recess means and engaged with said retainer plate to resiliently bias the retainer plate toward extended position.

5. The window sash as defined in claim 4 wherein said peripheral frame is rectangular with at least one side having at least two retainer plates mounted therein.

6. The window sash as defined in claim 5 wherein at least three sides of said peripheral frame each have two retainer plates mounted therein.

7. The window sash as defined in claim 6 wherein the fourth side of said peripheral frame is inserted laterally between the inner and outer flanges on the window frame when the peripheral frame is angularly disposed with respect to the window frame.

8. A take-out window sash for use with a window frame having a pair of laterally spaced inwardly extending flanges with the outer flange having an inner edge disposed inwardly of the inner edge of the inner flange, said window sash having an outer edge insertable through the inner flange and into engagement with the interior surface of the outer flange, said window sash including a peripheral frame including a peripheral inner flange aligned with the inner flange on the window frame and means carried by said peripheral frame engaging the interior surface of said inner flange on the window frame for securing the window sash in the window frame, said securing means being movable between an extended position extending laterally of the inner flange on the peripheral frame and engaged with the interior surface of the inner flange on the window frame and a retracted position disengaged from the inner flange on the window frame, said securing means including a retainer completely concealed by the inner flange on the window frame and the inner flange on the peripheral frame when the take-out sash is mounted in the window frame.

9. The window sash as defined in claim 8 wherein said securing means includes a plurality of pivotal latch members mounted on the peripheral frame, each of said pivotal latch members comprising a retainer plate having an arcuate plate rigid with one edge thereof and being swingable in an arcuate path for retraction completely within the confines of the peripheral frame, said peripheral frame being generally channel-shaped with the inner flange thereof including an aperture enabling access to each arcuate plate for retracting the arcuate plate from engagement with the inner flange on the window frame.

10. The window sash as defined in claim 9 wherein the outer flange of the channel-shaped peripheral frame includes a longitudinal groove pivotally receiving the other edge of the retainer plate, the apertured inner flange including inwardly offset portions securing the retainer plate from longitudinal movement in the channel-shaped peripheral frame after insertion to facilitate ease of assembly.

11. The window sash as defined in claim 10 together with spring means biasing said retainer plate and arcuate plate toward extending position and enabling retraction thereof when the peripheral frame is moved past the inner flange on the window frame.

* * * * *